US008275284B2

(12) United States Patent
Kihara et al.

(10) Patent No.: US 8,275,284 B2
(45) Date of Patent: Sep. 25, 2012

(54) IMAGE FORMING APPARATUS

(75) Inventors: Hideo Kihara, Suntou-gun (JP); Motonari Ito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/712,703

(22) Filed: Feb. 25, 2010

(65) Prior Publication Data

US 2010/0221028 A1 Sep. 2, 2010

(30) Foreign Application Priority Data

Mar. 2, 2009 (JP) ..... 2009-048098
Feb. 9, 2010 (JP) ..... 2010-026387

(51) Int. Cl.
*G03G 15/08* (2006.01)

(52) U.S. Cl. ..... 399/103; 399/260; 399/284

(58) Field of Classification Search ..... 399/38, 399/53, 98, 102, 103, 105, 106, 119, 120, 399/252, 258, 260, 262, 284
See application file for complete search history.

(56) References Cited

U.S. PATENT DOCUMENTS 6,178,302 B1 1/2001 Nagashima et al.
6,516,168 B2 2/2003 Shiratori et al.
2003/0161644 A1 * 8/2003 Yokoi et al. ..... 399/27

FOREIGN PATENT DOCUMENTS

JP 20000035733 2/2000

* cited by examiner

*Primary Examiner* — Walter L Lindsay, Jr.
*Assistant Examiner* — Bejamin Schmitt
(74) *Attorney, Agent, or Firm* — Fitzpatrick, Cella, Harper & Scinto

(57) ABSTRACT

An image forming apparatus includes a cartridge detachably mountable to a main assembly thereof. The cartridge includes a developer carrying member for carrying a developer, a conductive member contactable to the carrying member, a developing chamber for holding the carrying member and the conductive member, a developer accommodating chamber for accommodating the developer, and a seal member for sealing an opening between the developing chamber and the developer accommodating chamber. The apparatus further includes a seal member removing device, and a control device. The control device controls concurrently performing seal member removal and driving of the carrying member when the cartridge is mounted to the main assembly and then sends a detection signal signaling failure of removal of the seal member when a potential difference is provided between the carrying member and said conductive member during the execution of the control.

6 Claims, 8 Drawing Sheets

(a) BEFORE SEAL MEMBER REMOVAL (b) AFTER SEAL MEMBER REMOVAL (a) BEFORE AUTOMATIC SEAL MEMBER REMOVAL (b) AFTER AUTOMATIC SEAL MEMBER REMOVAL

IMAGE FORMING APPARATUS

FIELD OF THE INVENTION AND RELATED ART

The present invention relates to an image forming apparatus, to which a cartridge is detachably mountable, for forming an image on a recording material (medium). Here, the image forming apparatus includes those of an electrophotographic type, an electrostatic recording type, a magnetic recording type, and the like, such as a copying machine, a printer (e.g., an LED printer, a laser beam printer, or the like), a facsimile machine, and the like. An image bearing member is a member on which a latent image (electrostatic latent image, potential latent image, resistive latent image, magnetic latent image, or the like) to be developed with a developer is to be formed. For example, as the image bearing member, it is possible to use an electrophotographic photosensitive member (photoconductor) in an electrophotographic process, an electrostatic recording dielectric member in an electrostatic recording process, a magnetic recording member in a magnetic recording process, and the like.

In the electrophotographic image forming apparatus, a process cartridge type has been conventionally known. In this type, an electrophotographic photosensitive drum as the image bearing member (hereinafter referred to as a drum) and at least a developing device (developing unit) of process means acting on the drum are integrally supported to prepare a process cartridge. The process cartridge is detachably mounted to a main assembly of the image forming apparatus (apparatus main assembly) and then is used. Further, a developing cartridge type is also known. In this type, a developing cartridge constituted only by the developing device separately from the drum is detachably mounted to the apparatus main assembly and then is used. Herein, the above-described process cartridge type and developing cartridge type are inclusively referred to as a cartridge type. According to the cartridge type, maintenance of the apparatus can be performed by a user himself (herself) without relying on a service person, so that operativity is considerably improved. For that reason, the cartridge type has been widely used in the electrophotographic image forming apparatus.

With respect to the developing device in the cartridge, a developing frame (developing device frame) for holding a developing roller or the like as a rotatable developer carrying member for developing with the developer the latent image formed on the drum and a developer frame (hopper) in which the developer is accommodated are connected to each other. Further, with respect to the developing unit in a fresh cartridge in a state before factory shipment and before use, an opening provided at the connecting portion between the developing frame and the developer frame is hermetically sealed with a seal member. As a result, the developer accommodated in the developer frame is prevented from moving toward the developing frame, so that leakage of the developer during a distribution process of the cartridge is prevented. When the process cartridge or the developing cartridge is used, the seal member is removed (from the opening) to permit movement of the developer from the developer frame side to the developing (frame) side. The removal of the seal member is carried out by the user before a fresh process or developing cartridge is mounted to the apparatus main assembly. Then, the cartridge from which the seal member is removed is mounted to the apparatus main assembly and thereafter is used.

In recent years, a cartridge provided with an automatic removing device for automatically removing the seal member without performing the seal member removal by the user and an image forming apparatus capable of driving the automatic removing device of the cartridge are also proposed. With respect to a cartridge which is not provided with the automatic removing device, the user mounts the cartridge to the apparatus main assembly is some cases without removing the seal member, so that a means for automatically detecting whether or not the seal member was removed has been desired. U.S. Pat. No. 6,178,302 has proposed a technique in which an electroconductive portion provided to the cartridge is disconnected by removing the seal member and the disconnection is detected on the apparatus main assembly side to permit detection of the removal of the seal member.

With respect to the cartridge provided with the automatic removing device, there is no failure in removal of the seal member by the user but there is possibility that the seal member is broken during automatic removal thereof. Further, in the case where the image forming apparatus is not provided with a means for detecting the removal of the seal member, an automatic removing operation is required also when the cartridge which has already been subjected to the removal of the seal member is inserted into the apparatus, so that it takes much time until the user can effect printing. In view of this problem, U.S. Pat. No. 6,516,168 has proposed a technique in which drive for seal member removal is performed by a dedicated motor and a value of a current passing through the motor is measured to detect whether or not the seal member removal is carried out.

SUMMARY OF THE INVENTION

The present invention has further developed the above-described conventional constitutions.

A principal object of the present invention is to accurately and inexpensively detect a removal state of a seal member of a cartridge in an image forming apparatus of the type wherein the removal of the seal member is automatically performed.

Another object of the present invention is to inexpensively detect whether or not a seal member of a cartridge is performed in an image forming apparatus of the type wherein the removal of the seal member is performed by a user.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[Embodiment 1]

(1) Image Forming Portion

Figure 2:
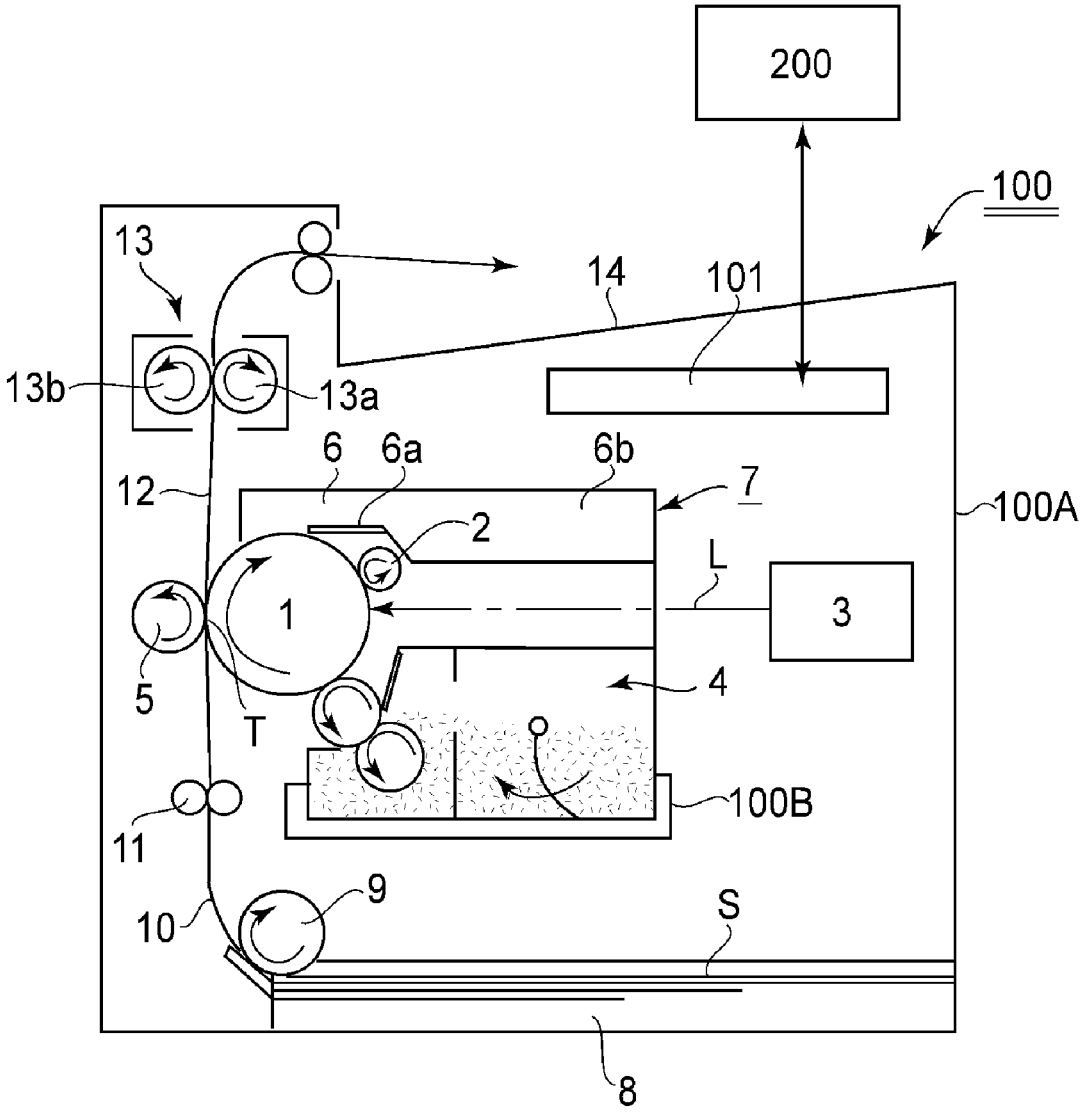
FIG. 2 is a schematic structural view of an image forming apparatus in Embodiment 1.

FIG. 2 is a schematic structural view of an image forming apparatus 100 in this embodiment. The image forming apparatus 100 is an electrophotographic image forming process for forming an image on a recording material (medium) S by applying a series of electrophotographic image forming processes including charging, exposure, development, transfer, and cleaning to a rotatable electrophotographic photosensitive member 1 as an image bearing member. Further, the printer is of a cartridge type in which a process cartridge 7 provided with an automatic removing device (hereinafter referred to as a cartridge) is detachably mounted to a cartridge mounting portion 100B in a main assembly 100A of the image forming apparatus 100 (herein referred to as an apparatus main assembly).

Specifically, an image is formed on the recording material correspondingly to an electric image signal input from an external host device 200 such as a personal computer into a control circuit portion (control means: engine controller) 101 of the image forming apparatus 100. The control circuit portion 101 transfers various pieces of information between the external host device 200 and itself and also effects centralized control of all the operation sequences of the image forming apparatus in accordance with predetermined control program and reference table. The recording material is an image formable product such as a recording sheet (paper), an OHP sheet, or a cloth. Further, the recording material may also be an intermediary transfer member such as an intermediary transfer drum or an intermediary transfer belt.

In this embodiment, process means for executing the above-described series of electrophotographic image forming processes include a drum-type electrophotographic photosensitive member (hereinafter referred to as a drum) 1 and a contact charging member 2 as a charging means for electrically charging the drum 1. Further, the process means also include an image exposure device 3 as an image exposure means for forming an electrostatic latent image by subjecting the charged surface of the drum 1 to image exposure, a developing device (developing unit) 4 as a developing means for developing the electrostatic latent image with a developer into a visual image as a developer image (toner image), a transfer roller 5 as a transfer means for transferring the toner image onto the recording material S, and a cleaning device 6 as a cleaning means for cleaning the surface of the drum 1 after the transfer.

In this embodiment, a cartridge 7 is prepared by integrally supporting the drum 1, the contact charging member 2, the developing device 4, and the cleaning device 6 of the above-described process means as a unit. These constituent elements are mounted in the cartridge with a predetermined mutual arrangement relationship. The cartridge 7 is inserted into and mounted to the mounting portion 100B in the apparatus main assembly 100A in a predetermined manner. Further, the cartridge 7 can be pulled out and demounted from the mounting portion 100B of the apparatus main assembly 100A. The cartridge 7 is positionally fixed and held with respect to the apparatus main assembly 100A in a state in which the cartridge 7 is mounted to the mounting portion 100B in the predetermined manner. To a drive input portion (not shown) of the cartridge 7, a drive output portion (not shown) of the apparatus main assembly 100A is connected. As a result, a mechanical driving force is inputtable from a driving source (not shown) of the apparatus main assembly 100A to the cartridge 7. To an input electric contact (not shown) of the cartridge 7, an output electric contact (not shown) of the apparatus 100A is connected. As a result, a required bias is applicable from a driving portion (not shown) of the apparatus main assembly 100A to the cartridge 7.

The drum 1 is rotationally driven in a clockwise direction indicated by an arrow at a predetermined peripheral speed (process speed) with predetermined control timing of operation sequence control of the image forming apparatus. The contact charging member 2 electrically charges the drum surface in contact with the surface of the drum 1. In this embodiment, the contact charging member 2 is an electroconductive roller (hereinafter referred to as a charging roller) disposed in contact with the drum 1 and is rotated, in a counterclockwise direction indicated by an arrow, by the rotation of the drum 1. To this charging roller 2, a predetermined charging bias is applied from a power portion (not shown) of the apparatus main assembly. As a result, the surface of the rotating drum 1 is charged uniformly to a predetermined polarity and a predetermined potential (dark portion potential). In this embodiment, the charging bias having a negative polarity and a predetermined potential is applied to the charging roller, so that the drum surface is uniformly charged to a predetermined negative potential.

The image exposure device 3 is, in this embodiment, a laser beam scanner including a laser/polygonal mirror/lens system. A laser beam L modulated depending on an image signal is output from the image exposure device 3 in a scanning manner, so that the drum surface uniformly charged by the charging roller 2 is subjected to laser beam scanning exposure. By this exposure, the surface potential of the drum surface at an exposed portion is attenuated to a light portion potential (i.e., electric charges are removed), so that an electrostatic latent image corresponding to an image exposure pattern is formed on the drum surface by an electrostatic contrast between the light portion potential and the dark portion potential. The electrostatic latent image is developed as a developer image (toner image) by the developing device 4. In this embodiment, the developing device 4 is of a non-magnetic one component contact developing type. The developing device 4 is a reversal developing device using toner having a negative charge polarity as the developer and the developer is deposited on the drum surface at the exposed portion, thus developing the electrostatic latent image. Details of the developing device 4 will be described later.

A sheet-like recording material S accommodated in a sheet-feeding cassette 8 in a stacked manner is separated and fed one by one by a sheet-feeding roller 9 driven with predetermined control timing to be conveyed to a registration roller pair 11 through a sheet path 10. The registration roller pair 11 feeds the recording material S to a transfer nip T as a control portion between the drum 1 and the transfer roller 5. The recording material S enters the transfer nip T and is nip-conveyed. To the transfer roller 5, a predetermined transfer bias (a voltage of an opposite polarity (positive in this embodiment) to the toner charge polarity and a predetermined potential) is applied. As a result, the toner image formed on the drum surface is electrostatically transferred successively on the surface of the recording material S. The recording material S coming out of the transfer nip T is separated from the surface of the drum 1 and passes through a sheet path 12 to be introduced into a fixing device 13. The fixing device 13 is of, e.g., a heat roller type in which the recording material S is nip-conveyed in a fixing nip formed between a fixing roller 13*a* and a pressing roller 13*b*, so that the unfixed toner image is fixed as a fixed image on the recording material under heat and pressure.

Then, the recording material S on which the image is fixed is discharged to a discharge portion 14 outside the apparatus. Further, transfer residual developer (untransferred developer) remaining on the drum 1 after the separation of the recording material is removed by the cleaning device 6. The drum 1 having the surface cleaned by the cleaning device 6 is used repeatedly for image formation. The cleaning device 6 is, in this embodiment, of a blade type using an elastic cleaning blade 6*a* as a cleaning member. The blade 6*a* is disposed in control with the drum 1 with an edge opposing the drum 1 counter directionally with respect to the rotational direction of the drum 1. The untransferred developer on the drum surface is removed by the blade 6*a* and is stored in a residual developer accommodating chamber 6*b*.

(2) Cartridge 7

As the cartridge 7 is used for image formation, the developer accommodated in the developing device 4 is consumed. Then, when the developer is consumed to the extent that the image of a satisfactory quality for the user having purchased the cartridge cannot be formed loses its commercial value. For this reason, e.g., a means (not shown) for detecting a remaining developer amount in the cartridge is provided. Then, in the control circuit portion 101, the detected remaining developer amount (value) is compared with a preset threshold for providing advance notice or warning of lifetime of the cartridge. When the detected remaining developer amount is less than the threshold, the advance notice or warning of the lifetime of the cartridge is displayed at a display portion (not shown). As a result, the user is urged to prepare a cartridge for exchange or to exchange the cartridge, so that a quality of the output image is maintained.

Figure 3:
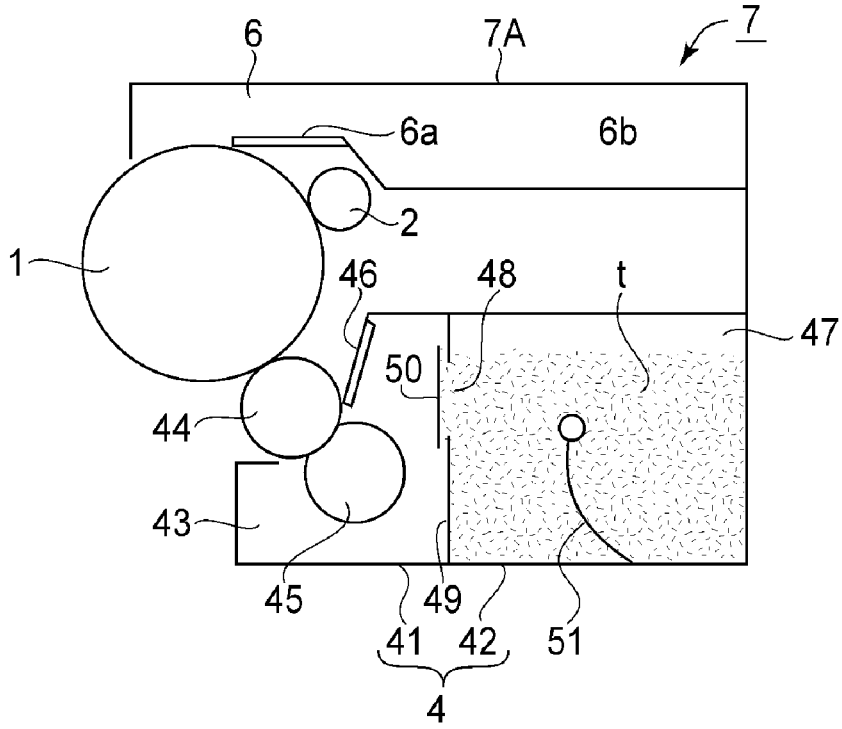
FIG. 3(*a*) is a schematic cross-sectional view of a cartridge before seal member removal and FIG. 3(*b*) is a schematic cross-sectional view of the cartridge after the seal member removal.
Figure 3:
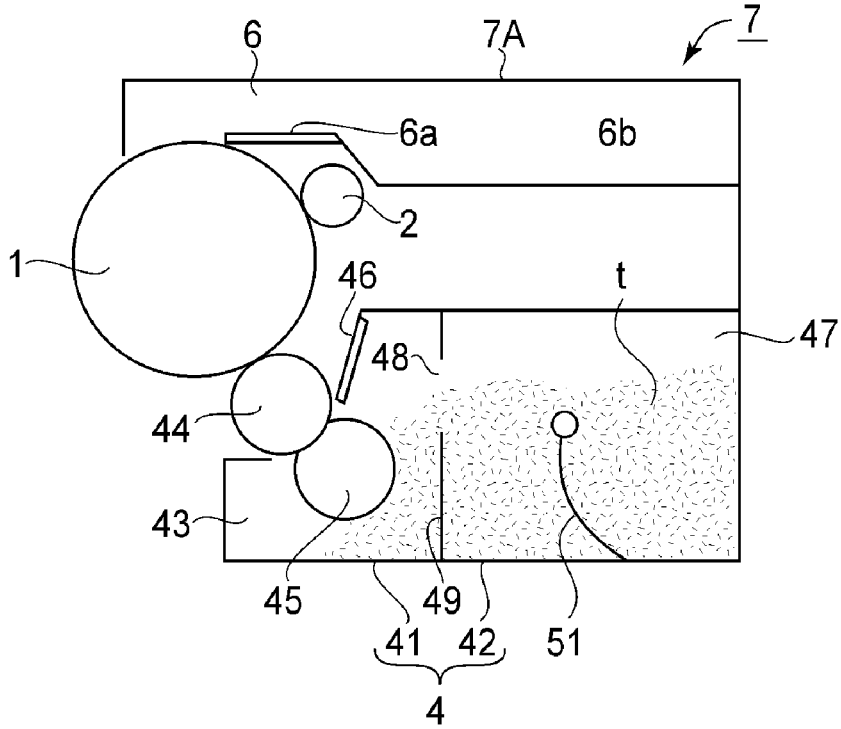

FIG. 3(*a*) is a schematic cross-sectional view of a fresh cartridge 7 before seal member removal and FIG. 3(*b*) is a schematic cross-sectional view of the cartridge 7 after the seal member removal. The cartridge 7 in this embodiment is, as described above, prepared by integrally supporting the drum 1, the charging roller 2, the developing device 4, and the cleaning device 6 as a unit. These constituent elements are assembled in the cartridge with a predetermined mutual arrangement relationship. More specifically, the cartridge 7 is prepared by connecting a drum unit 7A into which the drum 1, the charging roller 2, and the cleaning device 6 are assembled and the developing device 4 (a developing unit) in a swingable manner. The drum 1 and the charging roller 2 are rotatably provided to a frame of the drum unit 7A. The charging roller 2 is disposed in parallel and contact with the drum 1 with a predetermined urging force. Further, the drum unit 7A and the developing device 4 are rotationally urged about a connecting portion (not shown) by an urging member (not shown) so that the drum 1 and a developing roller 44 of the developing device 4 are kept in a predetermined contact state.

The developing device 4 includes a developing device frame 41 and a developer frame (hopper) 42 which are connected to each other. The developing device frame 41 includes a developing chamber 43. To the developing chamber 43, the developing roller 44 as a rotatable developer carrying member for developing with the developer the latent image formed on the drum 1 is provided at a position where the developing roller 44 opposes the drum 1. Further, in the developing chamber 43, a supplying roller 45 as a developer supplying member for supplying the developer to the developing roller 44 is rotatably provided on an opposite side from the drum 1 side with respect to the developing roller 44. Further, to the developing chamber 43, a regulating blade 46 (electroconductive member) as a regulating member for regulating an amount of the developer carried on the developing roller 44 in contact with the developing roller 44 is provided. The regulating blade 46 is fixed to the developing device frame 41 at a base portion. Further, an end of the regulating blade 46 elastically contacts the developing roller 44, at a position which is downstream of a contact position between the developing roller and the supplying roller 45 and upstream of an opposing position between the drum 1 and the developing roller 44 with respect to the rotational direction of the developing roller 44. The regulating blade 46 is, in this embodiment, formed of SUS. As the regulating blade 46, it is also possible to use other metals having electroconductivity. The developing roller 44 is disposed in parallel with the drum 1. The supplying roller 45 is disposed in parallel and contact with the developing roller 44 with a predetermined urging force. The regulating blade 46 is disposing along a longitudinal direction of the developing roller 44.

The developer frame 42 is a developer container for accommodating the developer and includes a developer accommodating chamber 47 in which a developer t is accommodated in a predetermined initial amount. The developing chamber 43 and the developer accommodating chamber 47 are partitioned by a partitioning wall 49 having an opening 48 for establishing communication between the chambers 43 and 47. The opening 48 is formed in an elongated slit shape extending in a shaft direction of the developing roller 44 as a longitudinal direction.

The opening 48 of the fresh (new) cartridge 7 to be shipped from the factory is sealed (covered) with a seal member (toner seal) 50. FIG. 3(*a*) shows a state in which the opening 48 is sealed with the seal member 50. As a result, the developer t accommodated in the developer accommodating chamber 47 is kept in a state in which the developer t is confined in the developer accommodating chamber 47 and the developing chamber 43 is in a state in which there is no developer t thereon.

When the fresh cartridge 7 is used, the opening 48 is placed in an open state by removing the seal member 50. FIG. 3(*b*) shows a state in which the opening 48 is unsealed. As a result, both of the developing chamber 43 and the developer accommodating chamber 47 communicate with each other through the opening 48 and are placed in a state in which the developer t in the developer accommodating chamber 47 can be fed into the developing chamber 43. The developer t in the developer accommodating chamber 47 is successively fed into the developing chamber 43 through the opening 48 by rotationally driving a stirring and feeding member 51 disposed in the developer accommodating chamber 47. The cartridge 7 in this embodiment is provided with an automatic removing device (automatic removing mechanism) for automatically removing the seal member 50.

Figure 4:
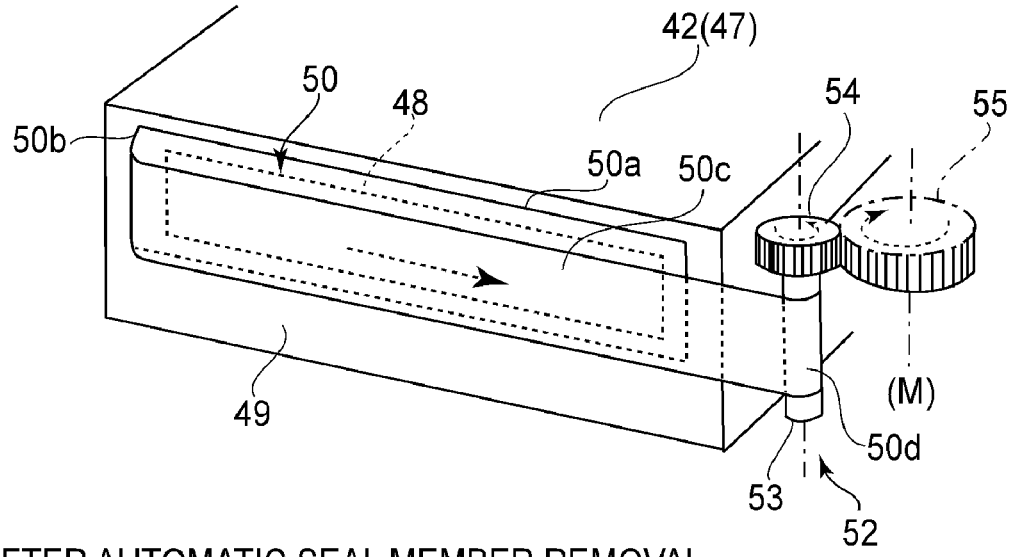
FIG. 4(*a*) is an explanatory view showing a state of an automatic removing device before automatic seal member removal and FIG. 4(*b*) is an explanatory view showing a state of the automatic removing device after the automatic seal member removal.
Figure 4:
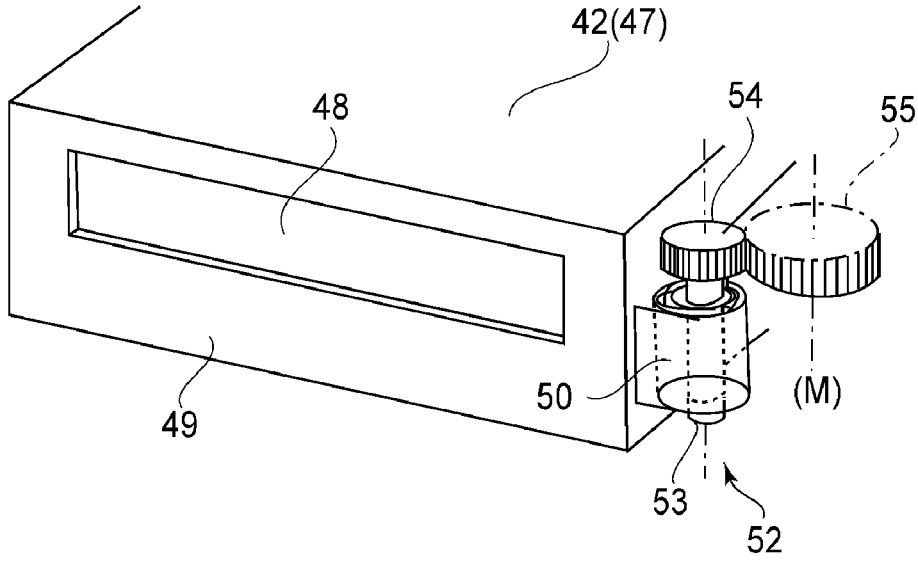

FIGS. 4(*a*) and 4(*b*) are explanatory views of the automatic removing device, wherein FIG. 4(*a*) shows a state before automatic seal member removal and FIG. 4(*b*) shows a state after the automatic seal member removal. Referring to FIG. 4(*a*), the seal member 50 is welded to the opening 48 of the partition wall 49 by hot melting or the like. The seal member 50 seals the opening 48 by applying a sealing portion 50*a* extending from a right side to a left side in FIG. 4(*a*) to a periphery of the opening 48. The left-side portion of the sealing portion 50*a* is extended as an extended portion 50*c* which is folded back at a folding portion 50*b* and is extended toward the right-side portion. An end portion 50*d* of the folded extended portion 50*c* is fixed to a winding-up shaft 53 constituting the automatic removing device 52 (sealing portion removing means) disposed on the right side of the developer frame 42. The winding-up shaft 53 is a vertical shaft member rotatably disposed through a shaft supporting member (not shown) on the right side of the developer frame 42. At an upper end portion of the winding-up shaft 53, a drive input gear 54 is fixed.

The cartridge 7 is, as shown in FIG. 4(*a*), mounted to the mounting portion 100B of the apparatus main assembly 100A in the state in which the seal member is kept unremoved. In the state in which the cartridge 7 is mounted to the mounting portion 100B in the predetermined manner, the drive input gear 54 of the automatic removing device 52 on the cartridge 7 side is placed in an engaged state with a drive output gear 55 on the apparatus main assembly 100A side. The winding-up shaft 53 is rotationally driven through the drive input gear 54 by driving the drive output gear 55. As a result, the extended portion 50*c* of the seal member 50 is wound up by the winding-up shaft 53. With this winding-up, the sealing portion 50*a* which has sealed the opening 48 is gradually peeled off the opening 48 from the left side toward the right side. That is, the opening 48 is gradually unsealed from the left side toward the right side. Then, finally, the sealing portion 50*a* itself of the seal member 50 is also wound up by the winding-up shaft 53, so that the entire opening 48 is placed in an unsealed state as shown in FIG. 4(*b*). That is, the seal member 50 of the cartridge 7 is automatically removed. The winding-up shaft 53 is driven by transmitting thereto a driving force for driving the cartridge 7 from a driving source M on the apparatus main assembly side through the drive output gear 55 and the drive input gear 54, so that the removal of the seal member 50 and drive of the developing roller 44 are simultaneously performed.

Figure 5:
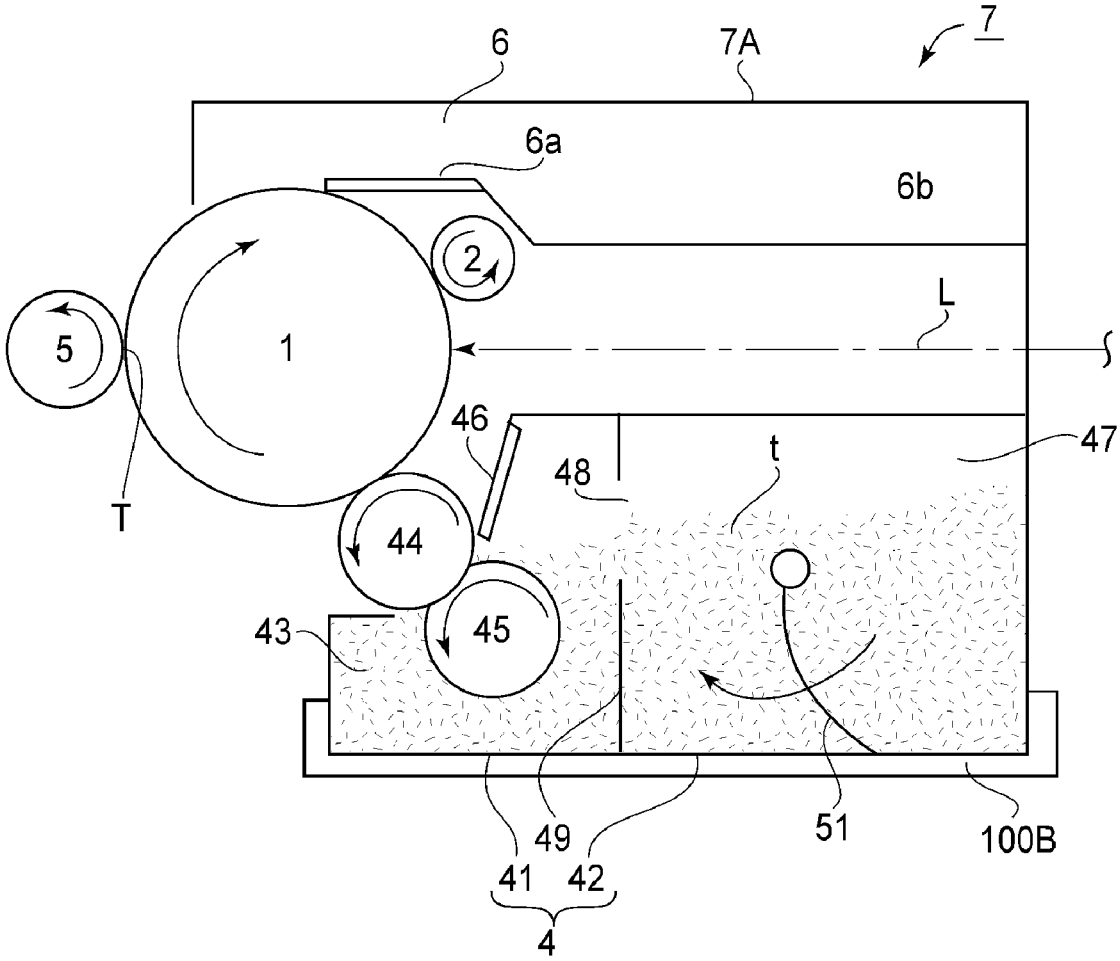
FIG. 5 is a schematic view for illustrating an operation of a developing device.

The drive of the cartridge 7 is effected by inputting the driving force from the drive output portion of the apparatus main assembly 100A into the drive input portion of the cartridge 7 in the state in which the cartridge 7 is mounted to the mounting portion 100B of the apparatus main assembly 100A. That is, in FIG. 5, the drum 1 is rotationally driven in the clockwise direction indicated by an arrow at a predetermined speed. The charging roller 2 is rotated by the rotation of the drum 1. The developing roller 44 is rotationally driven in the counterclockwise direction indicated by an arrow at a predetermined speed. The supplying roller 45 is rotationally driven in the counterclockwise direction indicated by an arrow at a predetermined speed. Further, the stirring and feeding member 51 is rotationally driven in the clockwise direction indicated by an arrow. In the case where the cartridge 7 is fresh (new) one, the drive of the cartridge 7 (the developing device 4) and the automatic winding-up of the seal member 50 by the rotation of the winding-up shaft 53 are performed at the same time. Then, by the rotation of the stirring and feeding member 51, the developer t in the developer accommodating chamber 47 is supplied to the developing chamber 43 through the opening 48. Then, the developer in the developing chamber 43 is supplied to the developing roller 44 by being urged against the surface of the developing roller 44 by the supplying roller 45. When the supplied developer enters and passes through a contact nip between the developing roller 44 and the regulating blade 46, a layer thickness of the developer is regulated to provide a thin developer layer having a uniform thickness. The developer is triboelectrically charged to the predetermined charge polarity. Then, by further rotation of the developing roller 44, the developer layer formed on the developing roller 44 is conveyed to an opposing portion (developing portion) at which the developing roller 44 opposes the drum 1. During image formation, a predetermined charging bias and a predetermined developing bias are applied from a power supply portion of the apparatus main assembly to the charging roller 2 and the developing roller 44, respectively. Thus, the electrostatic latent image formed on the drum 1 is developed.

(3) Detection of Removal State of Seal Member

In this embodiment, as described above, the removal of the seal member 50 of the fresh cartridge 7 is performed automatically. That is, the automatic removing device 52 provided to the cartridge 7 is driven by the driving source on the apparatus main assembly side to automatically perform the removal of the seal member 50.

The detection of the removal state of the seal member 50 means detection of whether or not the removal of the seal member 50 by the automatic removing device 52 is executed normally. The normal execution of the seal member removal means that the opening 48 is in an unsealed state over its full length area (normal completion of the seal member pulling. Further, seal member removal failure means that the opening 48 is in a state in which the unsealing thereof is not performed at all or in a state in which the unsealing thereof is completed at an intermediate position in the full length area of the opening 48 (failure in the seal member winding-up). The removal failure of the seal member 50 is caused by inoperativeness of the automatic removing device 52, separation between the winding-up shaft 53 and the end portion 50*d* of the extended portion 50*c* of the seal member 50, breakage of the extended portion 50*c* or sealing portion 50*a* of the seal member, and the like.

Figure 6:
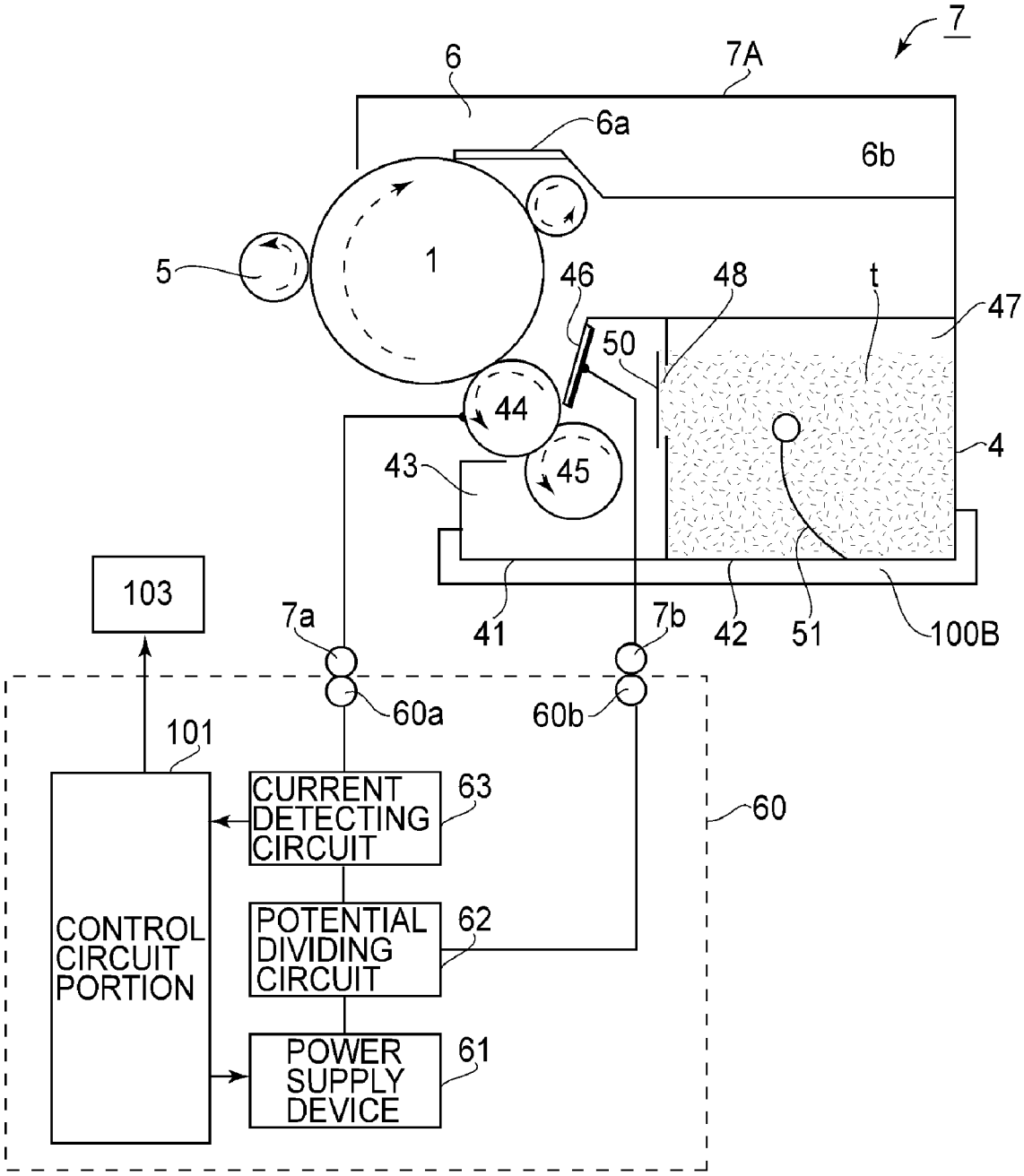
FIG. 6 is a block diagram of a seal member removal state detecting circuit.

FIG. 6 shows a state in which the fresh cartridge 7 including an unremoved seal member is mounted to the mounting portion 100B of the apparatus main assembly 100A. In this state, the cartridge 7 and a seal member removal state detecting circuit 60 of the apparatus main assembly 100A are electrically connected through electric contacts 7*a* and 7*b* on the cartridge 7 side and electric contacts 60*a* and 60*b* on the apparatus main assembly side. The seal member removal state detecting circuit 60 includes a power supply device 61, a potential dividing circuit 62, and a current detecting circuit 63 which are connected in series. The power supply device 61 is ON/OFF-controlled by the control circuit portion 101. From the current detecting circuit 63 into the control circuit portion 101, electrical information relating to a detected current value is input. The current detecting circuit and the developing roller 44 on the cartridge 7 side are in an electrically connected state through the electric contacts 60*a* and 7*a*. Further, the potential dividing circuit 62 and the regulating blade 46 on the cartridge 7 side are in the electrically connected state through the electric contacts 60*b* and 6*b*.

In this constitution, to the developing roller 44 and the regulating blade 46, different voltages which are divided voltages, by the potential dividing circuit 62, of a voltage output from the power supply device 61 are applied. In this embodiment, a potential difference is provided by applying a developing bias of −300 V to the developing roller 44 and applying a voltage of −500 V to the regulating blade 46. By this potential difference, a current (blade current) passes between the developing roller 44 and the regulating blade 46 and a value thereof is detected by the current detecting circuit 63.

When the fresh cartridge 7 including the unremoved seal member is mounted to the mounting portion 100B of the apparatus main assembly 100, drive of the cartridge 7, i.e., drive of the developing device 4 is started. Further, at the same time, the automatic removing device 52 is also driven to start the winding-up of the seal member 50, i.e., the automatic removal of the seal member 50. The unsealing of the opening 48 is successively performed from the left end toward the right end in FIG. 4(*a*). Further, by the rotational drive of the stirring and feeding member 51, the developer t in the developer accommodating chamber 47 is fed into the developing chamber 43 through the unsealed opening 48 and is supplied to the developing roller 44 by the supplying roller 45. Accordingly, a coating area of the developer on the developing roller 44 starts from the left end portion of the developing roller 44 and gradually extends toward the right end portion to finally reach over the entire area. When the developing roller 44 is coated with the developer, the layer of the developer enters between the developing roller 44 and the regulating blade 46, so that the value of the current passing between the developing roller 44 and the regulating blade 46 is smaller than that before the developing roller 44 is coated with the developer. Therefore, an amount of the current is gradually decreased in a period from the start of the unsealing of the opening 48 to completion of the coating of the developing roller 44 with the developer over the entire longitudinal area of the developing roller 44.

Figure 7:
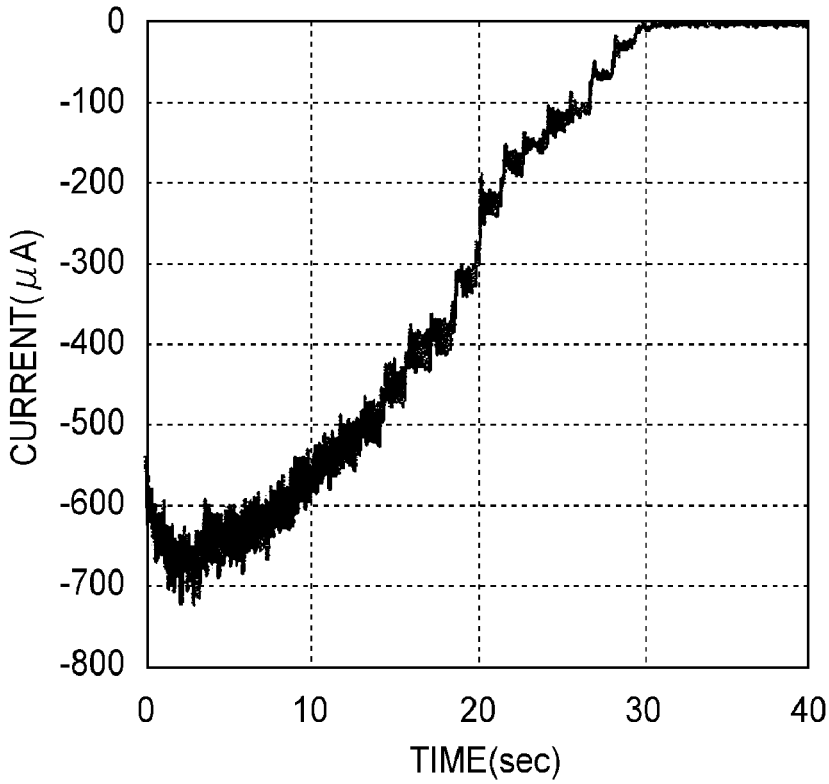
FIG. 7 is a graph showing a result of a change with time in (blade) current flowing from a regulating blade to a developing roller in an automatic removal process of the seal member.

FIG. 7 shows a result of measurement of the value of the (blade) current passing from the regulating blade 46 to the developing roller 44 in a process from the start of the winding-up of the seal member 50 until the developing roller 44 is coated with the developer over its entire longitudinal area.

In a time of about 30 seconds, the current value is changed from −700 μA to −2 μA. From this result, it is understood that the winding-up of the seal member 50 is completed in about 30 seconds from the drive start of the developing device 4 if the winding-up of the seal member 50 is normally performed.

Therefore, in this embodiment, the control circuit portion 101 judges that the seal pulling (seal member winding-up) is normally completed in the case where an absolute value of the current passing from the regulating blade 46 to the developing roller 44 in a period of 35 seconds (estimated by adding a margin to 30 seconds) from the drive start of the developing device 4 is decreased to 2 μA or less. That is, in this case, the control circuit portion 101 judges that the winding-up of the seal member 50 is normally completed. In the case where the current absolute value is not decreased to 2 μA or less even after the lapse of 35 seconds, the control circuit portion 101 judges that the winding-up of the seal member 50 is not completed. That is, the control circuit portion 101 judges that the seal member winding-up is failed. In the case where the cartridge 7 including the seal member 50 which has already been wound up is mounted, the developing roller 44 has been coated with the developer over the entire longitudinal area. For that reason, the absolute value of the current passing from the regulating blade 46 to the developing roller 44 does not exceed 2 μA. As a result, the control circuit portion 101 judges that the mounted cartridge 7 is the cartridge including the seal member 50 which has already been wound up.

The value of 2 μA as a current threshold (judgment reference current value) in this embodiment varies depending on resistance values of the developing roller 44 and the toner and the potential difference between the developing roller 44 and the regulating blade 46. For that reason, in the color image forming apparatus, the threshold is required to be changed every color in some cases. Further, the value of 35 seconds as an elapsed time threshold (judgment reference time) also varies depending on the shape of the container of the developing device 4, so that there is need to set the threshold every case where the container shape is changed. Further, in this embodiment, the completion of the seal member winding-up is detected by the current threshold but may also be judged that the winding-up is completed when the change in current is constant (when a differentiated value of the current value is zero).

Figure 1:
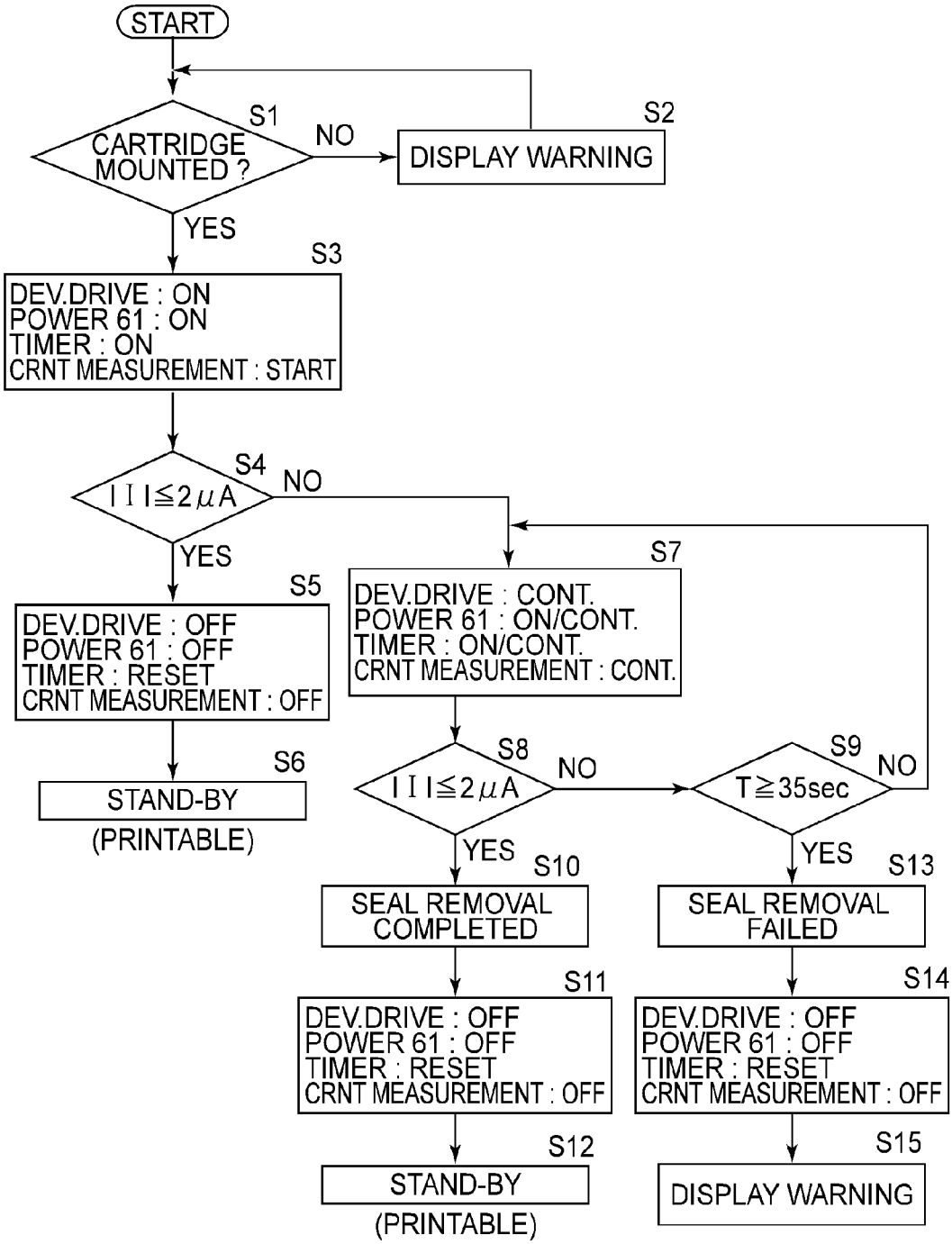
FIG. 1 is a flow chart of automatic removal sequence in Embodiment 1.

FIG. 1 is a flow chart a detection sequence for detecting the removal state of the above-described seal member 50. A main execution device of the flow chart is a CPU (central processing unit) of the control circuit portion 101 as the control means. The CPU controls the respective portions on the basis of programs and reference tables stored in storing portions (ROM, RAM). The CPU functions as an order determining means.

The mounting and demounting of the cartridge 7 with respect to the apparatus main assembly 100A is performed by opening an openable member (not shown) such as a front door or the like of the apparatus main assembly. When the openable member is opened, a kill switch (not shown) is turned off, so that the power supply circuit of the image forming apparatus is turned off. When the openable member is closed, the kill switch is turned on, so that the power supply circuit of the image forming apparatus is turned on.

The control circuit portion 101 detects, when the kill switch is turned off and then is turned on, whether or not the cartridge 7 is mounted to the mounting portion 100B of the apparatus main assembly 100A by a cartridge presence-absence detecting means (step S1). The cartridge presence-absence detecting means is not shown but can be an appropriate means such as a switch capable of being turned on when the cartridge 7 is mounted. In the case where the cartridge 7 is not mounted, warning display is made at a display portion 103 (FIG. 6) to urge the user to mount the cartridge (step S2). Incidentally, the display portion 103 may be provided to the image forming apparatus or may also be personal computer (PC) or the like connected to the image forming apparatus through the network.

In the case where the cartridge 7 is mounted, the control circuit portion 101 executes an actuating operation (recovery operation and warming operation) of the image forming apparatus. During the actuating operation, developing drive for winding up the seal member 50 by the automatic removing device 52 is started and at the same time the power supply device 61 for the seal member removal state detecting circuit 60 is turned on and timer is turned on (step S3). By the start of the developing drive, the rotations of the developing roller 44, the supplying roller 45, and the stirring feeding member 51 are started and at the same time the drive of the automatic removing device 52 is started. Further, by turning the power supply device 61 on, the voltage is applied to the developing roller 44 and the regulating blade 46 to start the measurement of the blade current (step S3).

The control circuit portion 101 makes the following judgment in the case where a detection current value |I| of the current detecting circuit 63 is not more than 2 μA as the threshold (i.e., a predetermined threshold or less) in this embodiment at the time of starting the blade current measurement. That is, the control circuit portion 101 judges that the seal member 50 of the mounted cartridge 7 has already been wound up (YES of step S4). Then, the control circuit portion 101 effects turning-off of the developing drive for winding up the seal member 50 by the automatic removing device 52, the power supply device 61, and the blade current measurement and effects resetting of the timer (step S5). Then, the control circuit portion 101 places the image forming apparatus in a printable stand-by state (step S6).

In the step S4, the detection current value |I| is larger than 2 μA (NO of step S4), the control circuit portion 101 continues the developing drive, the turning-on of the power supply device 61, the counting by the timer, and the blade current measurement (step S7). Then, the control circuit portion 101 judges whether the seal member winding-up (pulling) is normally completed or failed on the basis of the detection current value |I| of the current detecting circuit 63 (step S8) and a counting threshold T by the timer (step S9).

In the case of this embodiment, when the absolute value of the current passing from the regulating blade 46 to the developing roller 44 is lowered to 2 μA or less in the period of the counting threshold from the developing drive start (within the predetermined time) of 35 seconds, the control circuit portion 101 judges that the seal member winding-up (pulling) is normally completed (step S10). Then, the control circuit portion 101 effects the turning-off of the developing drive, the power supply device 61, and the blade current measurement and effects the resetting of the timer (step S11). Then, the control circuit portion 101 places the image forming apparatus in the printable stand-by state (step S12).

In the case where the current absolute value is not lowered to 2 μA or less even after the lapse of 35 seconds, the control circuit portion 101 judges that the winding-up of the seal member 50 is not completed (step S13). That is, when the detection current value is not the threshold or less in the predetermined time from the start of the developing drive, the control circuit portion 101 judges that the removal of the seal member 50 is failed and provides warning. Then, the control circuit portion 101 effects the turning-off of the developing drive, the power supply device 61, and the blade current measurement and effects the resetting of the timer (step S14). Then, the control circuit portion 101 steps the actuating operation and at the same time sends a detection signal, to the display portion 103 (FIG. 6), indicating that the control circuit portion 101 has judged that the removal was failed, so that warning display to the effect that the seal member winding-up is failed is effected at the display 103 to urge the user to deal with the warning (step S15).

As described above, in the case of this embodiment, in the state in which the cartridge 7 is mounted in the apparatus main assembly 100A, the control for simultaneously effecting the removal of the seal member 50 and the drive of the developing roller 44 is executed. Further, during the execution of this control, the potential difference is provided between the developing roller 44 and the regulating blade 46 and the value of current passing between the developing roller 44 and the regulating blade 46 is detected, so that the removal state of the seal member 50 is detected. The control circuit portion 101 judges the removal state of the seal member 50 on the basis of the current value and sends the detection signal for judging the seal member removal state. Further, the control circuit portion 101 controls, on the basis of the current value, the period (time) from the mounting of the cartridge 7 in the apparatus main assembly 100A until the image forming apparatus is placed in the stand-by state as the printable state (image formable state).

By employing the above-described detecting means, it becomes possible to detect the winding-up of the seal member 50 by utilizing the developing roller 44 and the regulating blade 46 which are required for the image forming process. For that reason, it is possible to know the completion of the winding-up of the seal member 50 with reliability without increasing the cost of the cartridge 7. Further, it is also possible to detect the case where the seal member 50 is broken during the winding-up and thus is wounded up only at a part thereof. Further, with respect to the cartridge in which the winding-up of the seal member 50 has already been completed, it is possible to quickly detect that the seal member 50 has been wound up. For that reason, there is no need to effect the developing drive for winding up the seal member 50, so that the user can quickly effects the printing. Further, in the case where the cartridge 7 is demounted during the seal member winding-up or the case where the image forming apparatus is stopped due to a power failure or the like, the cartridge 7 includes the seal member 50 which is partly removed. Even in the case where the cartridge 7 including the seal member 50 which is partly removed is mounted in the apparatus main assembly, completion timing of the winding-up can be quickly detected. Therefore, the developing drive for winding up the seal member 50 can be suppressed to a minimum, so that the time from the mounting of the cartridge in the apparatus main assembly until the image forming apparatus is placed in the stand-by state.

[Embodiment 2]

In this embodiment, cartridge such that the potential difference provided between the developing roller 44 and the regulating blade 46 during the seal member automatic winding-up is smaller than that during normal printing (during execution of the printing operation) is executed. First, the reason why the above control is executed will be described. In order to suppress melting of the developer onto the regulating blade 46, also during the normal printing, the provision of the potential difference between the developing roller 44 and the regulating blade 46 is effective. For the purpose of suppressing the melting of the developer, the potential difference may preferably be as large as possible. However, when the potential difference is increased, leakage is caused to occur between the developing roller 44 and the regulating blade 46, so that the surface potential of the developing roller 44 approaches the dark portion potential of the photosensitive drum 1. As a result, the developer coated on the developing roller 44 is also deposited on the photosensitive drum at the dark potential portion, so that background contamination or unnecessary consumption of the developer is caused to occur. When the coating amount of the developer on the developing roller 44 is small, a resistance between the regulating blade 46 and the developing roller 44 is decreased, so that the potential difference at which the leakage is caused is different between during the automatic seal member winding-up operation and during the printing after the completion of the automatic seal member winding-up operation.

In this embodiment, due to the above reason, suppression of the melting of the developer on the regulating blade 46 during the normal operation and prevention of the leakage during the automatic seal member winding-up are intended to be realized compatibly. In this embodiment, the control such that the potential difference between the developing roller 44 and the regulating blade 46 during the automatic seal member winding-up is smaller than that during the normal printing is executed. That is, the potential difference provided between the developer carrying member and the regulating member during the execution of the control is made smaller than that during the execution of the printing operation.

A difference of this embodiment from Embodiment 1 will be described below. In this embodiment, the potential difference between the developing roller 44 and the regulating blade 46 is changed between during the normal printing and during the automatic seal member winding-up, so that different voltages are applied to the developing roller 44 and the regulating blade 46 by different power supply devices, respectively. As applied voltages during the automatic seal member winding-up, a voltage of −300 V is applied to the developing roller 44 and a voltage of −500 V is applied to the regulating blade 46 similarly as in Embodiment 1. When the seal member winding-up is completed by using the same means as that in Embodiment 1, the user can effect the printing. When the user effects the printing, a voltage of −300 V is applied to the developing roller 44 and a voltage of −600 V is applied to the regulating blade 46.

By effecting the above-described control, it becomes possible to suppress the unnecessary toner consumption during the automatic seal member winding-up while suppressing the toner melting onto the regulating blade 46 during the normal printing. Incidentally, the applied voltage causing on leakage in this embodiment varies depending on the toner resistance or the resistance of the developing roller 44, so that the applied voltage is required to be changed every color of the toner in some cases.

[Embodiment 3]

Figure 8:
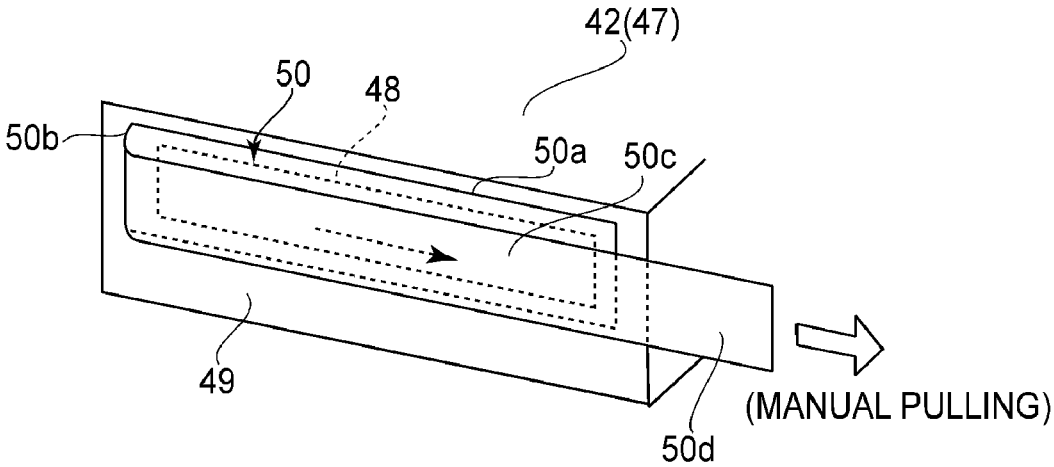
FIG. 8 is a schematic structural view of the seal member of a cartridge provided with no automatic removing device.

In this embodiment, a cartridge provided with no automatic removing device is employed. In the case of this cartridge, the end portion 50*d* of the extended portion 50*c* of the seal member 50 is protruded from the right-side surface of the cartridge 7 as shown in FIG. 8, thus constituting a handle at the time of removing the toner seal (seal member) 50 by the user. The user holds the end portion 50*d* of the seal member 50 before the fresh cartridge 7 is mounted in the apparatus main assembly and pulls out the seal member 50 to the outside the cartridge 7, thus removing the seal member 50 (manual removal). As a result, the opening 48 is unsealed. The cartridge 7 is mounted to the mounting portion 100B of the apparatus 100A and is used. That is, the cartridge 7 is detachably provided to the apparatus main assembly 100A in the state in which the seal member 50 of the cartridge 7 has been subjected to the manual removal.

When the seal member 50 is removed and then the cartridge 7 is mounted to the mounting portion 100B of the apparatus main assembly 100, drive of the developing device 4 is started in the above-described actuating operation of the image forming apparatus. Further, by the rotational drive of the stirring and feeding member 51, the developer t in the developer accommodating chamber 47 is fed into the developing chamber 43 through the manually unsealed opening 48 and is supplied to the developing roller 44 by the supplying roller 45. The opening 48 is unsealed over the entire longitudinal direction thereof, so that the developer is uniformly fed with respect to the longitudinal direction of the supplying roller 45. Therefore, the coating of the developer on the developing roller 44 is uniformly started with respect to the longitudinal direction of the developing roller 44. In the cartridge in this embodiment, the voltages are applied to the developing roller 44 and the regulating blade 46 in the same manner as in Embodiment 1. Then, when the detection of the current passing from the regulating blade 46 to the developing roller 44 is performed, the detection current value is changed from −700 μA to −2 μA in about 2 seconds from the start of the developing drive. Accordingly, in this embodiment, the control circuit portion 101 judges that the toner seal (seal member) 50 is not removed in the case where the current having the absolute value larger than 2 μA even after the lapse of more than 2 seconds from the start of the developing drive, and provides, to the user, warning for urging the user to remove the seal member 50.

In the cartridge provided with no automatic removing device, generally, the user shakes the cartridge several times for feeding the developer to the developing chamber 43 in some cases after the user removes the seal member 50 and before the cartridge is mounted in the apparatus main assembly 100A. For that reason, there is a possibility that the toner is fed to the developing chamber 43 in a sufficient amount although the seal member 50 is partly removed and then is broken to result in failure of the normal removal. Therefore, whether the seal member 50 is not normally removed due to the breakage in an intermediate stage of its removal or is normally removed cannot be strictly detected. In the cartridge provided with no automatic removing device in the developing chamber 43, whether or not the seal member 50 is removed can be detected.

Figure 9:
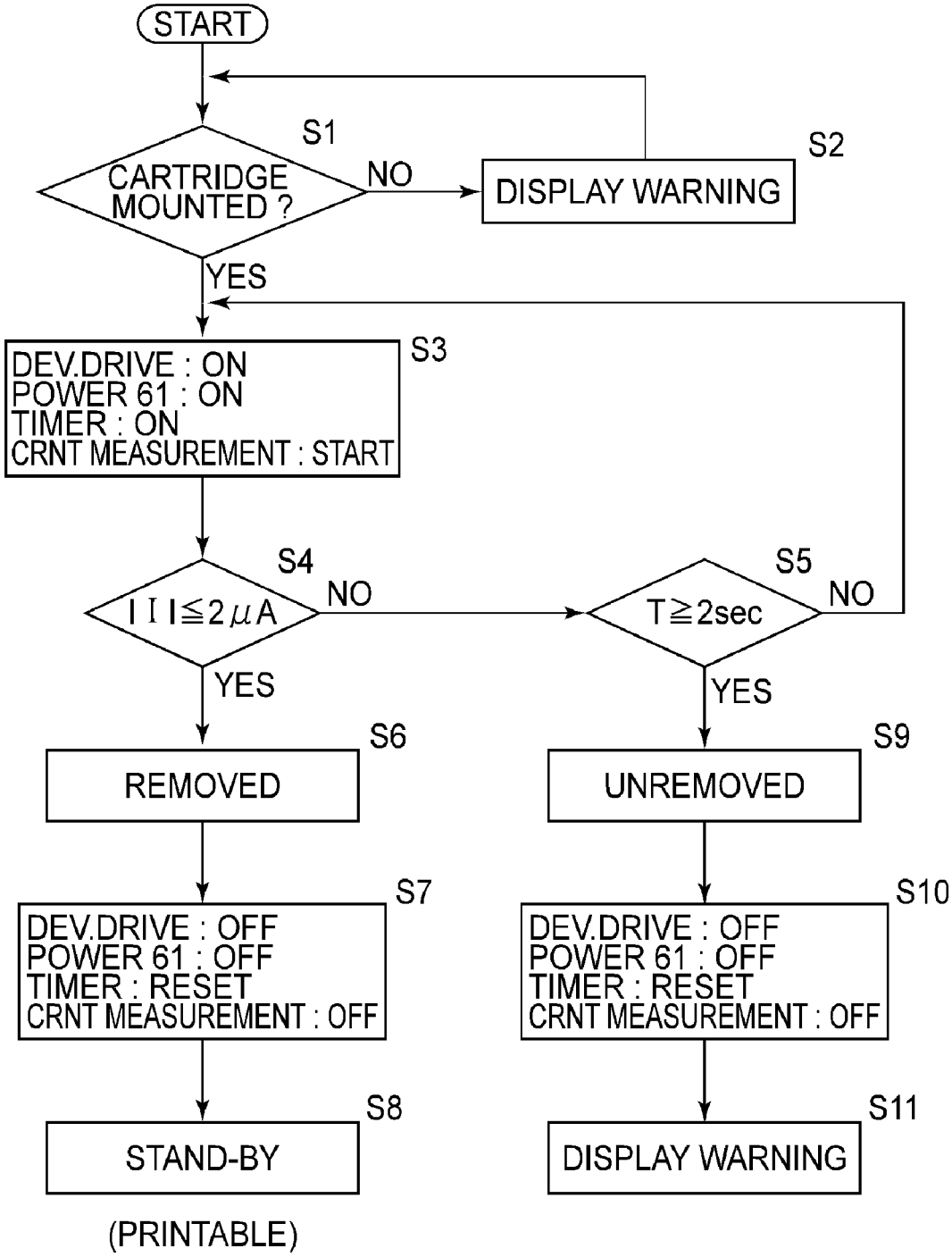
FIG. 9 is a flow chart of a sequence for performing detection of whether or not the seal member removal of the cartridge provided with no automatic removing device is carried out.

FIG. 9 is a flow chart a detection sequence for detecting the removal state of the above-described seal member 50.

The control circuit portion 101 detects, when the kill switch is turned off and then is turned on, whether or not the cartridge 7 is mounted to the mounting portion 100B of the apparatus main assembly 100A by a cartridge presence-absence detecting means (step S1). Similarly as in the case of Embodiment 1. In the case where the cartridge 7 is not mounted, the control circuit portion 101 displays warning at a display portion 103 (FIG. 6) to urge the user to mount the cartridge (step S2). In the case where the cartridge 7 is mounted, the control circuit portion 101 executes an actuating (starting) operation of the image forming apparatus. In this actuating operation, developing drive is started and at the same time the power supply device 61 for the seal member removal state detecting circuit 60 is turned on and timer is turned on (step S3). By the start of the developing drive, the rotations of the developing roller 44, the supplying roller 45, and the stirring feeding member 51 are started. Further, by turning the power supply device 61 on, the voltage is applied to the developing roller 44 and the regulating blade 46 to start the measurement of the blade current (step S3).

Then, the control circuit portion 101 judges whether or not the seal member 50 is removed on the basis of the detection current of the current detecting circuit 63 (step S4) and the counting by the timer (step S5).

In the case of this embodiment, when the absolute value of the current passing from the regulating blade 46 to the developing roller 44 in a time of the counting threshold of 2 seconds from the start of the developing drive is lowered to not more than the current threshold of 2 μA, the control circuit portion 101 judges that the seal member 50 is removed (step S6). Then, the control circuit portion 101 effects turning-off of the developing drive, the power supply device 61, and the blade current measurement and effects resetting of the timer (step S7). Then, the control circuit portion 101 places the image forming apparatus in a printable stand-by state (step S8). In the case where the detection current value |I| is not lowered to the current threshold of 2 μA or less even after the lapse of the counting threshold of 2 seconds, the control circuit portion 101 judges that the winding-up of the seal member 50 is not completed (step S9). Then, the control circuit portion 101 effects the turning-off of the developing drive, the power supply device 61, and the blade current measurement and effects the resetting of the timer (step S10). Further, the control circuit portion 101 stops the actuating operation and at the same time seconds a detection signal to the effect that the seal member removal is failed, so that the control circuit portion 101 displays, at the display 103 (FIG. 6), warning to the effect that the removal of the seal member 50 is not performed to urge the user to deal with the warning (step S11). The control circuit portion 101 judges the removal state of the seal member 50 on the basis of the detection current value and sends a detection signal for judging the removal state. Further, the control circuit portion 101 controls, on the basis of the detection current value, a time from the mounting of the cartridge in the apparatus main assembly until the image forming apparatus is placed in the stand-by state as the printable state (image formable state).

That is, when the detection current value is not the threshold or less in the predetermined time from the start of the developing drive, the control circuit portion 101 judges that the removal of the seal member 50 is not performed and provides warning.

As described above, in the case of this embodiment, in the state in which the cartridge 7 is mounted in the apparatus main assembly 100A, the control for effecting the drive of the developing roller 44 is executed. Further, during the execution of this control, the potential difference is provided between the developing roller 44 and the regulating blade 46 and the value of current passing between the developing roller 44 and the regulating blade 46 is detected, so that the presence or absence of the seal member 50 is detected.

As a result, the detection of the removal of the seal member 50 can be performed by using the developing roller 44 and the regulating blade 46 required in the electrophotographic image forming process, so that it becomes possible to detect whether or not the seal member 50 is removed, without increasing the cost of the cartridge.

Incidentally, also in Embodiment 3, similarly as in Embodiment 2, the potential difference between the developing roller 44 and the regulating blade 46 may be changed between during the normal printing and during the detection of the presence or absence of the seal member 50.

[Other Embodiments]

(1) In the seal member removal state detecting circuit 60, the power supply source for applying the voltages to the developing roller 44 and the regulating blade 46 may also be constituted as separate power supply sources to provide the potential difference between the developing roller 44 and the regulating blade 46.

Further, in the above-described embodiments, the current passing between the developing roller 46 and the regulating blade 46 is detected but the electroconductive member is not limited to the regulating blade 46 so long as it is contactable to the developing roller 44. For example, as the electroconductive member contactable to the developing roller 44, the supplying roller 45 may be used. Here, the electroconductive member refers to a member having a resistance such that a current to a detectable degree passes when the voltage is applied between the developing roller 44 and the electroconductive member. For example, in the constitution shown in FIG. 6, the voltage is applicable to the developing roller 44 and the supplying roller 45 and the current passing between the developing roller 44 and the supplying roller may be detected. The electroconductive member may only be required that the current detected between the developing roller 44 and the electroconductive member contacting the developing roller 44 is changed due to a change in state of the toner coated on the surface of the developing roller 44 by the removal of the seal member 50. Therefore, the electroconductive member for detecting the current may be newly provided at a periphery of the developing roller 44. However, by utilizing the regulating blade 46, the supplying roller 45, and the like which are originally provided as the electroconductive member for constituting the image forming apparatus, the effect of the present invention can be achieved inexpensively without increasing the number of parts.

Incidentally, after the layer thickness of the toner on the developing roller 44 is regulated by the regulating blade 46, the electrostatic latent image on the drum 1 is developed at the developing portion. For that reason, whether or not the image forming apparatus is in the printable state is affected by the state of the toner between the developing roller 44 and the regulating blade 46. Therefore, it is particularly preferable that the current passing between the developing roller 44 and the regulating blade 46 is detected.

(2) The developing device 4 is not limited to that of the contact type in which the developing roller 44 is brought into contact with the drum 1 as in the embodiments described above. The developing device 4 may also be of a jumping developing type in which the developing roller 44 is disposed opposed to and in non-contact with the drum with a predetermined small gap (spacing) by a spacer member.

(3) The image bearing member 1 is a member on which the latent image to be developed with the developer is to be formed. As the image bearing member 1, in addition to the electrophotographic photosensitive member in the electrophotographic process, it is possible to use an electrostatic recording member in an electrostatic recording process and a magnetic recording member in a magnetic recording process. Further, the type of the image bearing member 1 is not limited to the drum type but can also be an endless belt type in which the belt is moved and circulated and a web type in which the web is moved.

(4) The cartridge is not limited to the process cartridge but may also be the developing cartridge as described above. The cartridge at least includes the rotatable developer carrying member for developing with the developer the latent image formed on the image bearing member, the regulating member for regulating the amount of the developer carried on the developer carrying member in contact with the developer carrying member, and the developer container for accommodating the developer. The cartridge further includes the opening for permitting feeding of the developer in the developer container toward the developer carrying member and includes the seal member for removably sealing the opening. The cartridge is detachably mounted to the image forming apparatus main assembly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 048098/2009 filed Mar. 2, 2009 and 026387/2010 Filed Feb. 9, 2010, which are hereby incorporated by reference.

What is claimed is:

1. An image forming apparatus for forming an image on a recording material, comprising:

a cartridge detachably mountable to a main assembly of said image forming apparatus, said cartridge comprising: a developer carrying member that is rotatable and that carries a developer to develop with the developer a latent image formed on an image bearing member, an electroconductive member that contacts said developer carrying member and regulates an amount of the developer carried on said developer carrying member, a developing chamber that holds said developer carrying member and said electroconductive member, a developer accommodating chamber that accommodates the developer, and a seal member that seals an opening that permits communication between said developing chamber and said developer accommodating chamber;

a seal member removing unit that removes said seal member; and a control unit that executes control for performing removal of said seal member and drive of said developer carrying member in a state in which said cartridge is mounted to the main assembly of said image forming apparatus, wherein said control unit sends a detection signal, which indicates a failure in removal of said seal member, when a potential difference is provided between said developer carrying member and said electroconductive member by applying a DC voltage to at least one of said developer carrying member and said electroconductive member during the execution of the control and when a value of a current passing between said developer carrying member and said electroconductive member is not a predetermined threshold or less in a predetermined time from start of the control, wherein said control unit changes a magnitude of the DC voltage between starting of execution of a printing operation and ending of execution of the control so that the potential difference provided between said developer carrying member and said electroconductive member during the execution of the control is smaller than the potential difference provided between said developer carrying member and said electroconductive member during the execution of the printing operation.

2. The image forming apparatus according to claim 1, further comprising:

a display portion that displays a removal state of said seal member, wherein when said control unit sends the detection signal, said display portion displays a warning indicating the failure in removal of said seal member.

3. An image forming apparatus for forming an image on a recording material, comprising:

a cartridge detachably mountable to a main assembly of said image forming apparatus, said cartridge comprising: a developer carrying member that is rotatable and that carries a developer to develop with the developer a latent image formed on an image bearing member, an electroconductive member that contacts said developer carrying member and regulates an amount of the developer carried on said developer carrying member, a developing chamber that holds said developer carrying member and said electroconductive member, a developer accommodating chamber that accommodates the developer, and a seal member that seals an opening that permits communication between said developing chamber and said developer accommodating chamber, wherein said cartridge is detachably mounted to the main assembly of said image forming apparatus in a state in which removal of said seal member is carried out; and a control unit that executes control for performing drive of said developer carrying member in a state in which said cartridge is mounted to the main assembly of said image forming apparatus, wherein said control unit sends a detection signal, which indicates a failure in removal of said seal member, when a potential difference is provided between said developer carrying member and said electroconductive member by applying a DC voltage to at least one of said developer carrying member and said electroconductive member during the execution of the control and when a value of a current passing between said developer carrying member and said electroconductive member is not a predetermined threshold or less in a predetermined time from start of the control, wherein said control unit changes a magnitude of the DC voltage between starting of execution of a printing operation and ending of execution of the control so that the potential difference provided between said developer carrying member and said electroconductive member during the execution of the control is smaller than the potential difference provided between said developer carrying member and said electroconductive member during the execution of the printing operation.

4. The image forming apparatus according to claim 3, further comprising:

a display portion that displays a removal state of said seal member, wherein when said control unit sends the detection signal, said display portion displays a warning indicating the failure in removal of said seal member.

5. An image forming apparatus for forming an image on a recording material, comprising:

a cartridge detachably mountable to a main assembly of said image forming apparatus, said cartridge comprising: a developer carrying member that is rotatable and that carries a developer to develop with the developer a latent image formed on an image bearing member, an electroconductive member that contacts said developer carrying member and regulates an amount of the developer carried on said developer carrying member, a developing chamber that holds said developer carrying member and said electroconductive member, a developer accommodating chamber that accommodates the developer, and a seal member that seals an opening that permits communication between said developing chamber and said developer accommodating chamber;

a seal member removing unit that removes said seal member; and a control unit that executes control for performing removal of said seal member and drive of said developer carrying member in a state in which said seal member removing unit and said cartridge is mounted to the main assembly of said image forming apparatus, wherein said control unit permits a printing operation of said image forming apparatus when a potential difference is provided between said developer carrying member and said electroconductive member by applying a DC voltage to at least one of said developer carrying member and said electroconductive member during the execution of the control and when a value of a current passing between said developer carrying member and said electroconductive member is a predetermined threshold or less, wherein said control unit changes a magnitude of the DC voltage between starting of execution of the printing operation and ending of execution of the control so that the potential difference provided between said developer carrying member and said electroconductive member during the execution of the control is smaller than the potential difference provided between said developer carrying member and said electroconductive member during the execution of the printing operation.

6. An image forming apparatus for forming an image on a recording material, comprising:

a cartridge detachably mountable to a main assembly of said image forming apparatus, said cartridge comprising: a developer carrying member that is rotatable and that carries a developer to develop with the developer a latent image formed on an image bearing member, an electroconductive member that contacts said developer carrying member and regulates an amount of the developer carried on said developer carrying member, a developing chamber that holds said developer carrying member and said electroconductive member, a developer accommodating chamber that accommodates the developer, and a seal member that seals an opening that permits communication between said developing chamber and said developer accommodating chamber, wherein said cartridge is detachably mounted to the main assembly of said image forming apparatus in a state in which removal of said seal member is carried out; and a control unit that executes control for performing drive of said developer carrying member in a state in which said cartridge is mounted to the main assembly of said image forming apparatus, wherein said control unit permits a printing operation of said image forming apparatus when a potential difference is provided between said developer carrying member and said electroconductive member by applying a DC voltage to at least one of said developer carrying member and said electroconductive member during the execution of the control and when a value of a current passing between said developer carrying member and said electroconductive member is a predetermined threshold or less, wherein said control unit changes a magnitude of the DC voltage between starting of execution of the printing operation and ending of execution of the control so that the potential difference provided between said developer carrying member and said electroconductive member during the execution of the control is smaller than the potential difference provided between said developer carrying member and said electroconductive member during the execution of the printing operation.

* * * * *